United States Patent [19]

Carter

[11] 4,390,222

[45] Jun. 28, 1983

[54] LANYARD RELEASE/UMBILICAL ELECTRICAL CONNECTOR

[75] Inventor: David P. E. Carter, Laguna Niguel, Calif.

[73] Assignee: Automation Industries, Inc., Greenwich, Conn.

[21] Appl. No.: 301,308

[22] Filed: Sep. 11, 1981

Related U.S. Application Data

[63] Continuation of Ser. No. 81,009, Oct. 1, 1979, abandoned.

[51] Int. Cl.[3] ..... H01R 13/625; H01R 13/633

[52] U.S. Cl. ..... 339/45 M; 339/90 R

[58] Field of Search ..... 339/45 R, 45 M, 46, 339/90 R, 89 R, 89 M

[56] References Cited

U.S. PATENT DOCUMENTS

| | | | |
|---|---|---|---|
| 3,609,632 | 9/1971 | Vetter | 339/45 M |
| 3,848,950 | 11/1974 | McCormick | 339/90 R |
| 4,056,298 | 11/1977 | Cooper et al. | 339/90 R |
| 4,183,605 | 1/1980 | Arneson | 339/89 M |

*Primary Examiner*—Neil Abrams

*Attorney, Agent, or Firm*—Francis N. Carten

[57] ABSTRACT

A lanyard release/umbilical electrical connector with a collet, a coupling ring, and a detent shell. The collet has a base, a side extending from the base to a flange-lip extending radially inward at the top of the side (when seated on the base). The flange-lip has keyways corresponding to keys on the barrel of the receptacle. The collet is divided into three separate arc lengths. The coupling ring has provisions for attaching a lanyard and an internal sloping end portion which can ride over the collet base but not the collet side. A detent shell fits partially inside the opening in the coupling ring and has keys corresponding to those on a coupling nut and a nose which can slide underneath the collet base and side. The coupling ring and detent shell are resiliently held together so that a lanyard can pull the coupling ring back over the detent shell. The collet arc lengths provide rocker action under the force of the coupling ring internal sloped end and the detent shell nose. The rocker motion causes the flange-lip diameter to decrease, after the flange-lip is beyond the barrel keys, and mechanically locks the flange-lip and keys. Pulling the lanyard forcefully moves the coupling ring toward the detent shell. The internal sloped end and conical nose cooperate to open the diameter of the flange-lip; and the receptacle section and plug section are thereby unlocked.

10 Claims, 9 Drawing Figures

LANYARD RELEASE/UMBILICAL ELECTRICAL CONNECTOR

This is a continuation of application Ser. No. 06/081,009, filed Oct. 1, 1979, now abandoned.

BACKGROUND OF THE INVENTION

1. Field of the Invention

This invention relates to electrical connectors. Particularly, the invention relates to circular, umbilical electrical connectors having rapid mating/unmating, locking/unlocking characteristics, especially to such connectors capable of lanyard release.

2. Description of the Prior Art

Some uses of electrical connectors require rapid disengagement of the plug portion from the receptacle portion, or the activation of such disengagement by remote control, such as, in weapon stores ejection and missile staging requirements. A typical quick release trigger is provided by a wire loop, referred to as a lanyard. It is desirable to provide both lockup means to ensure maintenance of electrical mating and quick release (disengagement) means for separation of the plug portion from the receptacle portion. Illustrative of prior art lanyard release connectors are U.S. Pat. Nos. 3,119,645; 3,848,950; and 4,083,619.

SUMMARY OF THE INVENTION

The invention herein is directed to a lanyard release umbilical electrical connector possessing lockup means to ensure maintenance of electrical circuit mating and a quick release means for both lockup and mated conditions, preferably by a lanyard trigger means. The invention applies to circular electrical connectors having mating/unmating capability of the sets of electrical contacts.

The receptacle means section of the connector of the instant invention includes a receptacle shell provided with a receptacle barrel, having a nose portion. and a set of electrical contacts. The barrel is provided with a plurality of keys, positioned circumferentially on the exterior surface of the barrel. Each of the keys is squared at the end farthest from the nose of the barrel; each of the squared ends is located on a common circumference around the barrel.

The plug means section of the connector of the instant invention includes a set of electrical contacts, and a plug shell comprising (a) a collet, (b) a coupling ring means, and (c) a detent shell.

The receptacle contacts and the plug contacts are capable of mating/unmating to complete/to break and this mating/unmating is accomplished by a to and fro (back and forth) movement of the plug means on an axis common to the receptacle axis.

The mating/unmating action is carried out by an axial movement imparted by cammed rotational movement of the plug shell. Desirably such cammed rotational movement is imparted by a high pitch thread element included in the plug section. Such rotational movement involves substantially less than one rotation. The axial movement not only mates the two sets of electrical contacts but also locks the plug section to the receptacle section. This lockup takes place through cooperation of the receptacle barrel keys and the collet member of the plug means.

The collet has a ring member with a flange-lip extending radially inward toward the center of the ring member; the ring member terminates in a base. The flange-lip has an internal diameter slightly smaller than the outside diameter of the keys. The collet is mounted in the plug section so that the flange-lip faces the keys on the receptacle barrel. Keyways are cut into the end of the flange-lip to match the keys on the barrel. The collet is divided (cut) into a plurality of circumferential lengths (arc lengths) these circumferential lengths are completely separate from one another. Herein "plurality" includes two arc lengths. Desirably at least three circumferential lengths are present.

The coupling ring means has a ring opening portion large enough in diameter to closely enclose the collet base. The coupling ring means includes a resilient means permitting pull back of the coupling ring means. Desirably the resilient means is a spring and a rod member support therefor.

The detent shell has an element for contacting the resilient means of the coupling ring means. Also the detent shell has a nose portion, desirably of a substantially conical shape, for cooperating in decreasing the diameter of the flange-lip as the coupling ring is advanced axially against the ring member of the collet during the mating/locking action.

The connector of this invention includes a quick release trigger means for activating the unlocking/unmating action by pulling the coupling ring means backward, away from the receptacle.

The separate circumferential lengths of the collet move in rocker motion under the influence of the coupling ring means and the detent shell nose. As the axial mating movement proceeds, the collet keyways engage the keys of the receptacle barrel and the flange-lip advances to a plane even with squared ends of the keys. Continuation of the axial and rotational movement causes the flange-lip to rotate far enough to permit each of the lands between the keyways to move into contiguous relation with one of the squared ends of the keys. The forces acting on the collet ring member impart a rocker motion to each circumferential length of the collet. This rocker motion lifts the base and causes an appreciable decrease in diameter of the flange-lip, thereby the flange-lip is brought into a friction-locked, abutted relation with the squared ends of the keys.

The quick release means, desirably a lanyard, causes an axial movement of the plug section away from the receptacle section. The coupling ring is forcefully separated from its contact with the side of the ring member of the collet; rocker motion is imparted to the collet circumferential lengths, causing the flange-lip to assume a diameter larger than that of the keys, thereby unlocking the plug section from the receptacle section. Axial movement continues causing the plug section to unmate from the receptacle section. Trigger means, other than a lanyard, may be used, for example, a stripper plate.

BRIEF DESCRIPTION OF THE FIGURES

FIGS. 2–4 show the members of this embodiment which comprise the improvement made over the prior art of this class of connectors.

DETAILED DESCRIPTION OF AN EMBODIMENT

Figure 1:
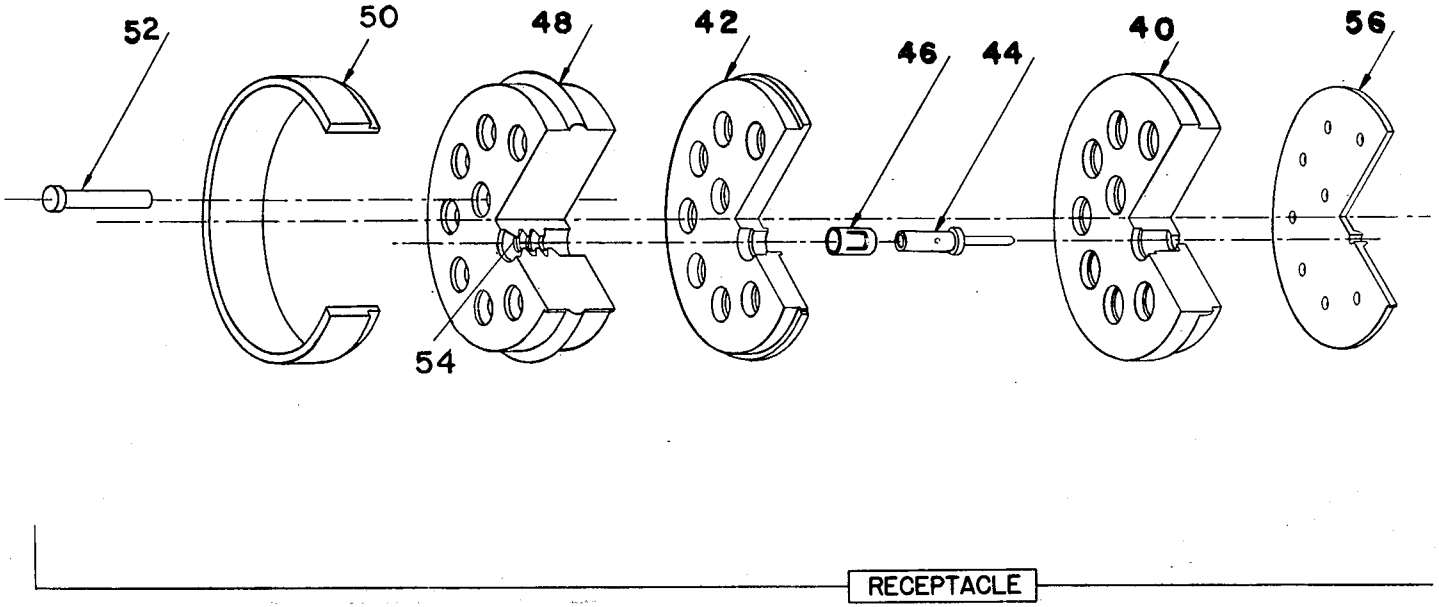
FIGS. 1–6 show an exploded view of one embodiment of the electrical connector of the invention.
Figure 2:
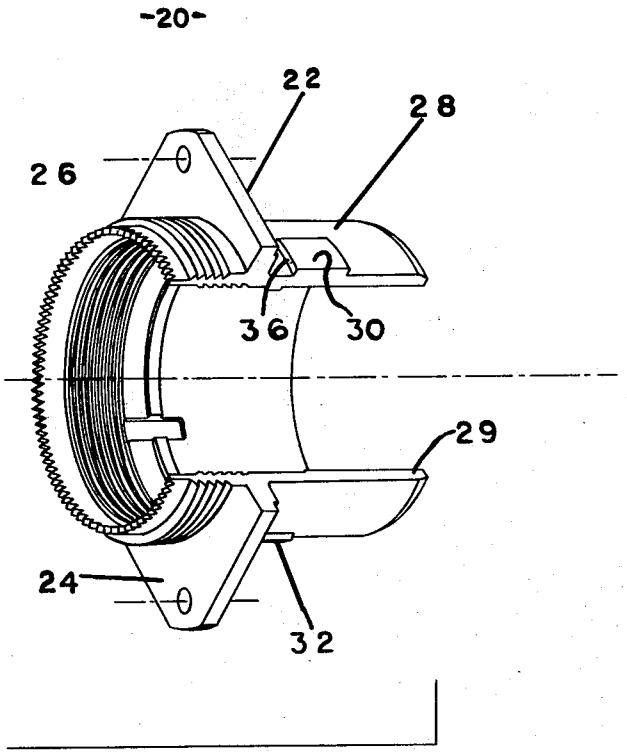

FIGS. 1–2 show one form of receptacle means (section) 20 which is suitable for mounting on a surface, such as an aircraft skin. In FIG. 2, receptacle means 20 includes a receptacle shell 22 which is provided with a mounting flange 24; a threaded portion 26 to which a back shell, not shown, can be mounted and admit into receptacle means 20 an electrical cable, not shown, whose wires are joined to retainers within receptacle means 20; and a barrel 28 which projects outwardly from mounting flange 24 and terminates in nose 29.

Receptacle means 20 and plug means 60 (FIG. 3) are desirably polarized so that they can mate in only one unique orientation. In this embodiment, polarization is obtained by the circumferential exterior surface of receptacle barrel 28 with a plurality of keys 30, 32, et seq. (Hereinafter the use of the plural indicates that 'et seq' is to be understood.) Each of keys 30 has the end farthest from the nose 29 of barrel 28 squared and each of the squared ends 36 is located on a common circumference around barrel 28, that is, for each of keys 30 the distance from the squared end 36 to the nose 29 is the same as any other key. The height of each key above the exterior surface of barrel 28 need not be exactly the same; however, it is desirable that all keys 30 have the same height, that is, the upper surface of each key lies on the same diameter, taken from the long axis of receptacle shell 22. The keys 30 vary in width and are desirably asymmetrically distributed on the exterior surface of barrel 28 to allow the mating of receptacle shell 22 and plug means 60 (FIG. 3) in one unique position.

FIG. 1 shows one manner in which electrical contact pins are placed and secured in receptacle shell 22. Front pin insert 40 and rear pin socket insert 42 receive electrical contact pin 44 and contact pin retainer 46 respectively. These inserts 40 and 42 are made, typically, from rigid plastic insulator (dielectric) material, such as thermoset phenolic resin. A grommet seal 48 prevents dirt, dust, water, etc from entering the interior of the connector by way of the receptacle rear end. Grommet seal 48 is typically made from an elastomer, such as a silicone rubber. A conductive metal insert retaining ring 50 helps hold these members together when assembled. A plastic plug 52 closes and seals channel 54 in grommet 48. An elastomeric interface seal 56 is positioned on the outside face of pin insert 40; this seal 56 grips the pins very tightly to ensure a seal. The channels in the aforesaid inserts demonstrate that more than one contact pin is to be used in this connector. Individual electrical wires are brought into receptacle shell 22 from its rear end and are squeeze fitted into the sockets 42 by a conventional procedure. A detailed presentation of the function and material of construction of each of the aforesaid members shown in FIG. 1 is presented in McCormick and Selk, U.S. Pat. No. 3,848,950 and this patent is incorporated herein by reference.

FIGS. 3–6 show the plug means 60 (plug section) of the electrical connector of the invention.

Figure 3:
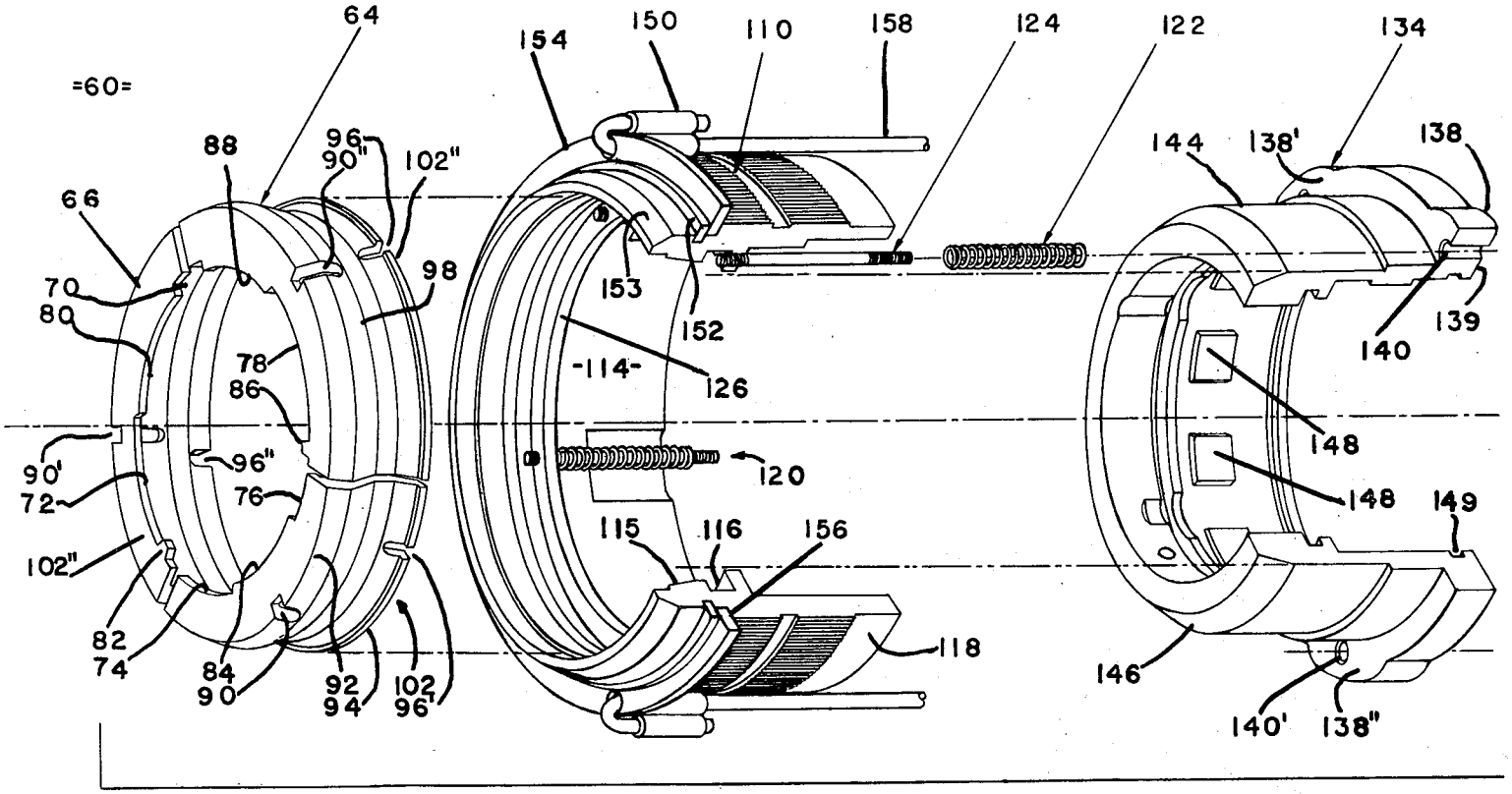

FIG. 3 shows three members which are primarily directed to the quick release (unlocking) of the locked/-mated electrical connector. Collet 64 has a flange-lip 66 extending radially inward. Flange-lip 66 has a number of keyways 70, 72, 74, 76, and 78, respectively. These keyways 70 correspond to keys 30 on receptacle barrel 28 (FIG. 2). Lands 80, 82, 84, 86, and 88 are located between aforesaid keyways 70. Flange-lip 66, when in one piece, has an internal diameter, measured across two opposing lands, slightly smaller than the outside diameter of aforesaid keys 30. Desirably the diameter is about the same as the outside diameter of barrel 28 (FIG. 2). Collet 64 contains three slots 90, 90', and 90'', intersecting flange-lip 66 and collet ring member 92. Ring member 92 terminates in base 94. Cut into base 94 and up into side 98 of ring member 92 are three notch-slots 96, 96', and 96''. Ring member 92 is shaped to move in rocker motion in response to force applied to side 98 and/or base 94. Herein the rocker motion is enhanced by having side 98 shaped roughly like one-half of an expanded hook, or a numeral '2' with a roughly flat top. The height of collet 64, measured vertically from base 94 to flange-lip 66, is such that the lands 80 overlap the squared ends 36 when the collet 64 is inserted over the barrel 28.

Collet 64 is divided (cut) into a plurality of circumferential lengths (arc lengths). At least three arc lengths 102, 102', and 102'' are desirable. Each circumferential length 102 is designed to move in rocker motion under the influence of force applied to or removed from ring member 92 especially to side 98. This rocker motion permits the diameter of the flange-lip, as measured at the lands thereon, to range from the outside diameter of barrel 28 (FIG. 2) to appreciably larger than the outside diameter of keys 30.

Figure 7:
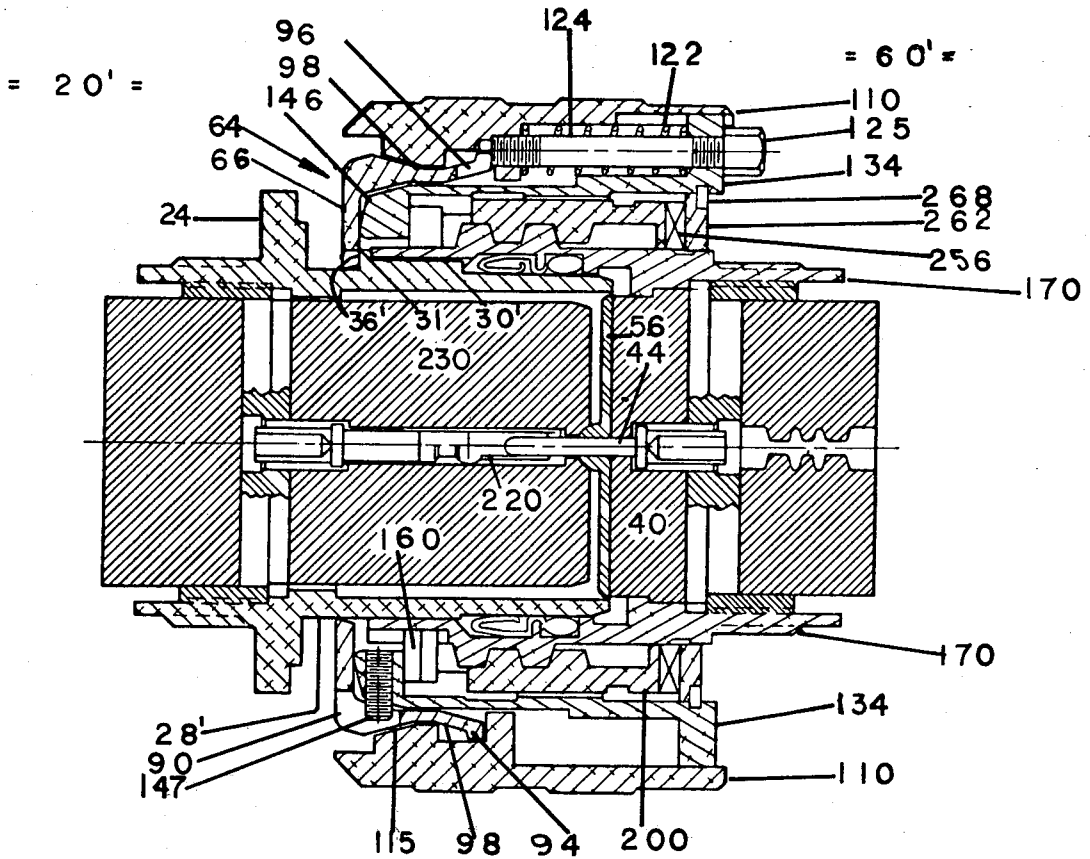
FIGS. 7–9 show, with each figure in section on two planes, stop-motion views of a connector of the invention, namely, locked/mated; unlocked/mated; and unmated. This embodiment is somewhat different in details from the embodiment of FIGS. 1–6.
Figure 8:
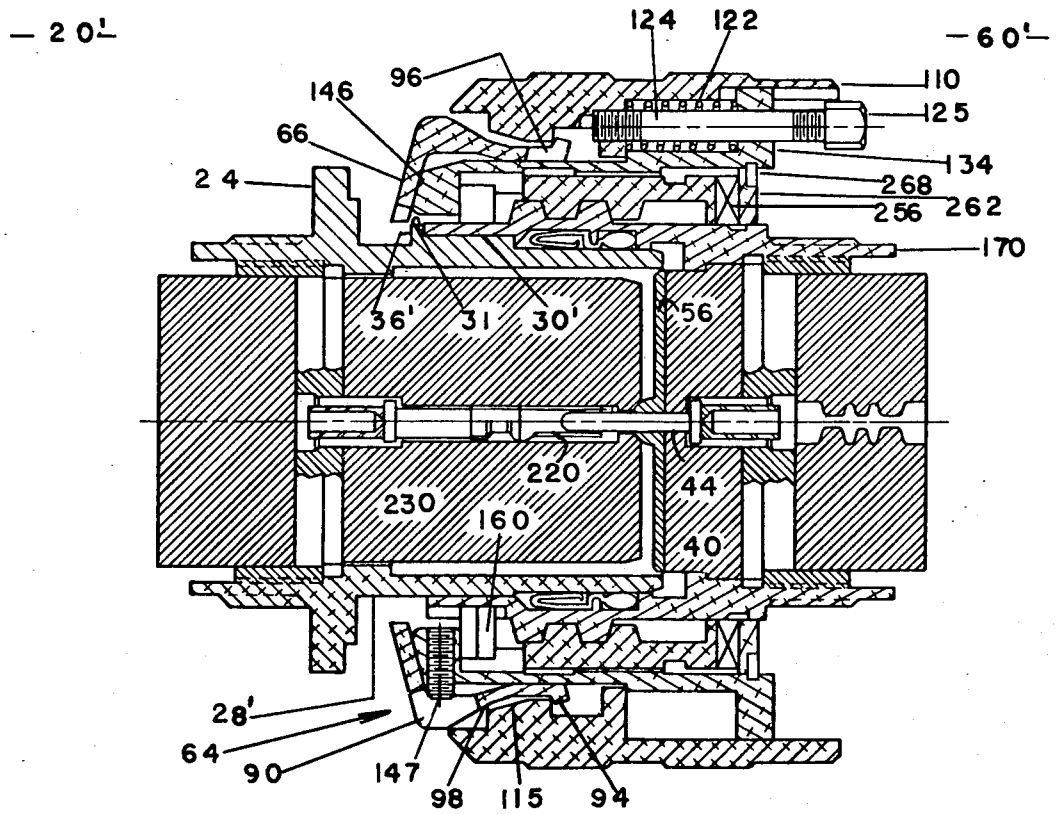
Figure 9:
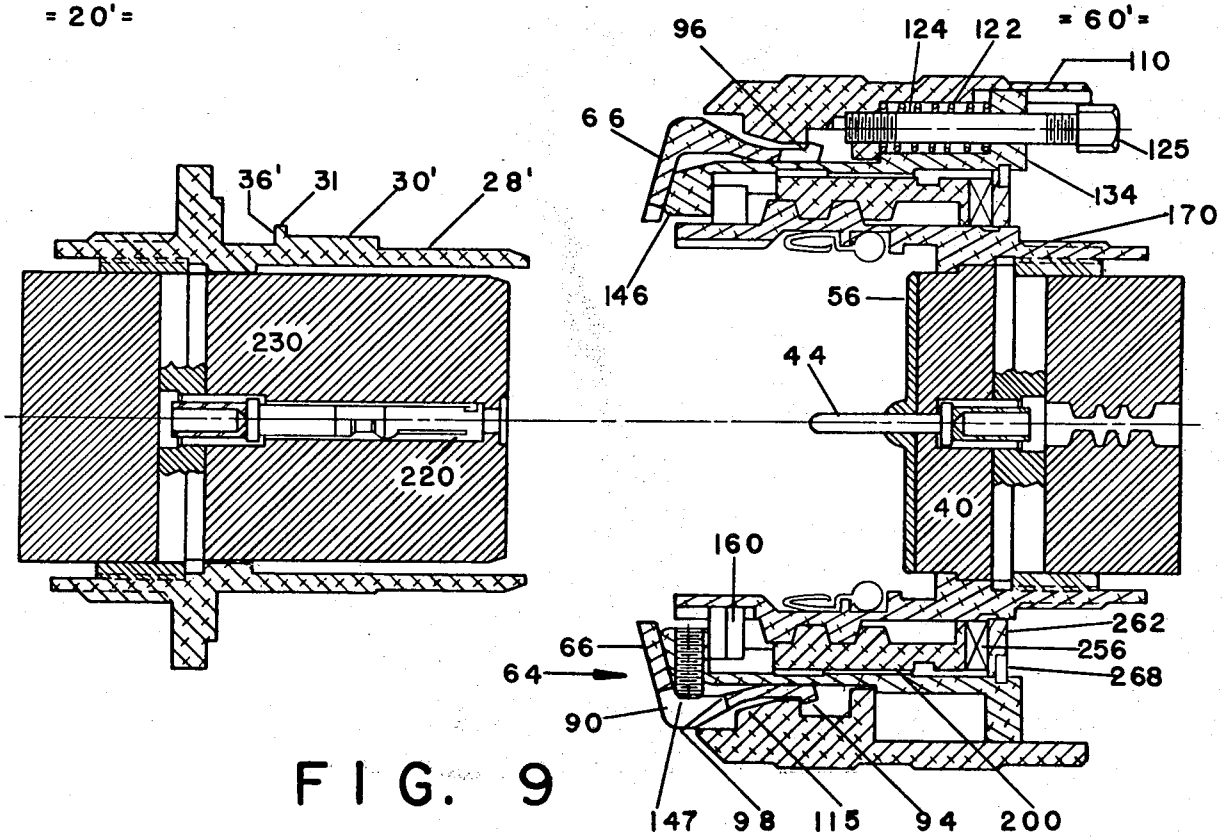

A spacing screw or stud, now shown in FIG. 3, may optionally be placed in detent shell 134, as shown in FIGS. 7–9, to be loosely enclosed by collet slots 90, et seq, when more stability of collet arc lengths 102 is desired.

Continuing in FIG. 3, a coupling ring means 110 is provided with a ring opening portion 114 slightly larger in diameter than collet base 94 but not large enough to enclose side 98. Collet base 94 fits loosely in annular groove 116 cut in the interior side of coupling ring shell 118. Coupling ring opening 114 provides a truncated outwardly directed conical element 115 at the end of the coupling ring which faces receptacle means 20.

Coupling ring 110 includes resilient means 120; herein resilient means 120 comprises a helical spring 122, a rod member support and guide therefor 124, which rod member 124 is fixed at one end to annular member 126 positioned inside of ring shell 118 and slidably fitted into a channel in detent shell 134. A sufficient number of resilient means is provided to have one or more for each collet circumferential length 102.

Continuing in FIG. 3, a circular detent shell 134 is provided with elements 138, 138', 138'' whose purpose is to contact resilient means 120. Here the other ends of rod members 124 enter into channels 140 where the corresponding ends of helical springs 122 are restrained by the walls 139 surrounding channels 140. As detent shell 134 moves toward coupling ring 110 and collet 64, helical springs 122 are compressed between wall 139, surrounding channel 140, and annular member 126. A nut, not shown here but see FIGS. 7–9, terminates rod 124 at wall 139 end.

Detent shell 134 has a nose portion 144 projecting toward coupling ring 110. This nose portion 144 cooperates with ring opening 114 and portion 115 to impart rocker motion to collet arc lengths 102 as the coupling ring 110 is advanced against side 98 of collet 64 along with nose portion 144 contacting the back side of flange-lip 66. Here nose portion 144 terminates in a substantially conical shape 146. The imparted rocker motion decreases the diameter of the flange-lip 66 as the coupling ring 110 moves toward receptacle shell 22 (FIG. 2) during mating/locking action of the connector, causing flange-lip 66 to lock against squared ends 36 of keys 30 in abutting relation.

Detent shell 134 is provided with a plurality of keys 148, 148' et seq on the inside wall thereof, and an annular groove 149.

Continuing in FIG. 3, coupling ring 110 is provided with a quick release trigger means 150 comprising support ring 152 located near end 153 of ring shell 118 and a member 154 rotatably positioned in an annular groove 156 cut into the outer surface of coupling ring 110 near end 153. Attached to member 154 is a strong, flexible wire, lanyard 158; only two portions of the lanyard cable are shown. A pull of lanyard 158 in the direction away from the receptacle section of the locked up connector moves coupling ring 110 back from the receptacle section as helical springs 122 are compressed by axial movement of the coupling ring 110 toward the circular detent shell 134. The forceful pull of the coupling ring causes the outwardly directed conical element 115 to withdraw from contact with collet side 98 and, with the help of detent nose 144, imparts rocker motion to the collet circumferential lengths 102, which rocker motion enlarges the diameter of the flange-lip 66 enough to permit the flange-lip to pass over keys 30, unlocking the receptacle section 20 from plug section 60 and an instant later causing unmating as the axial withdrawal movement continues.

Figure 4:
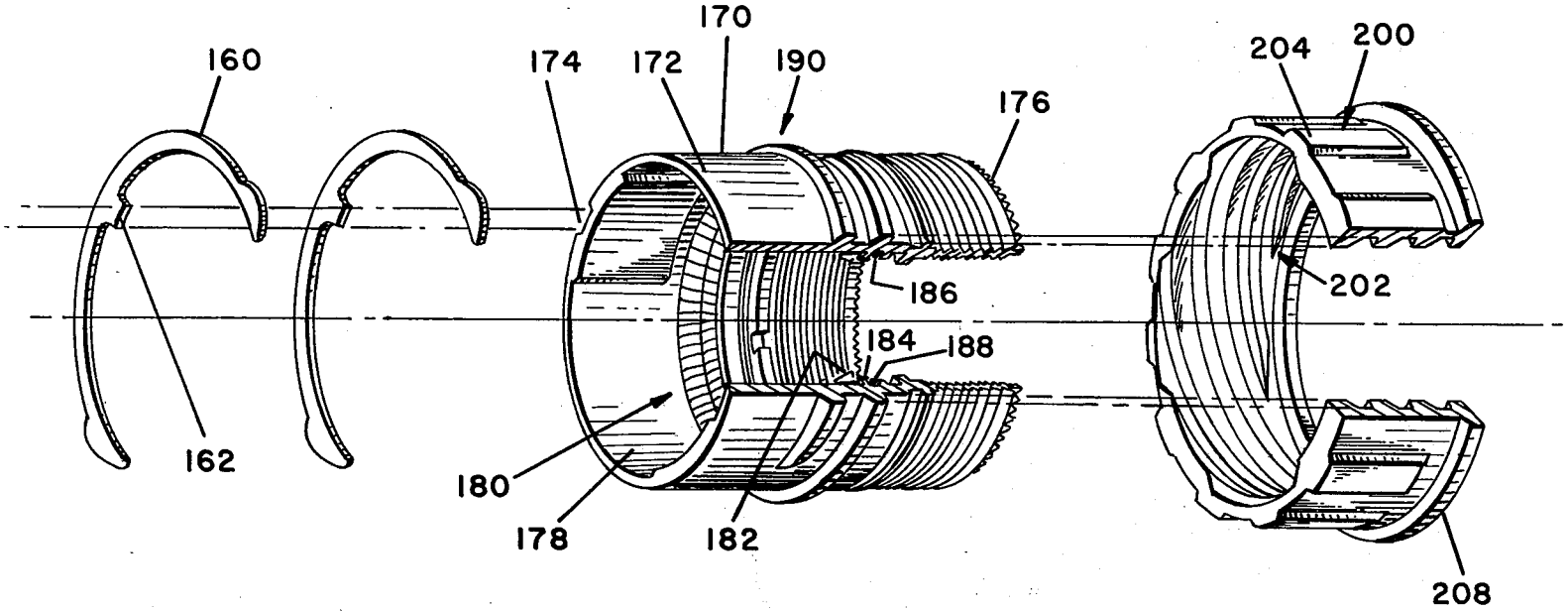
Figure 5:
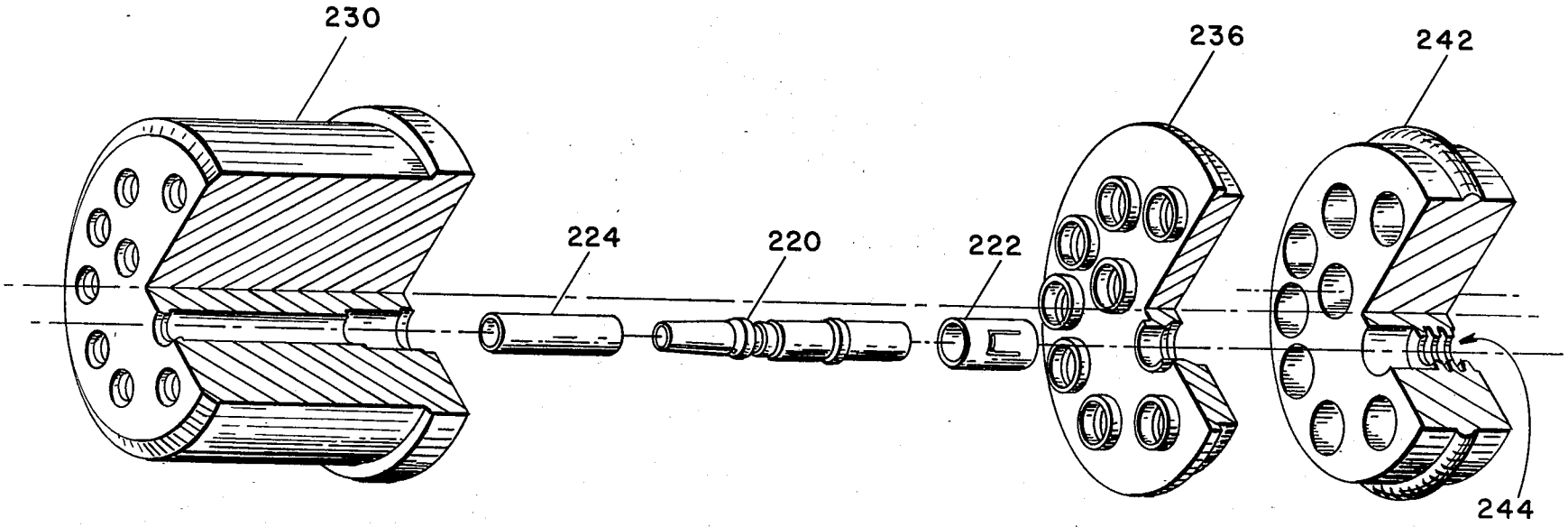
Figure 6:
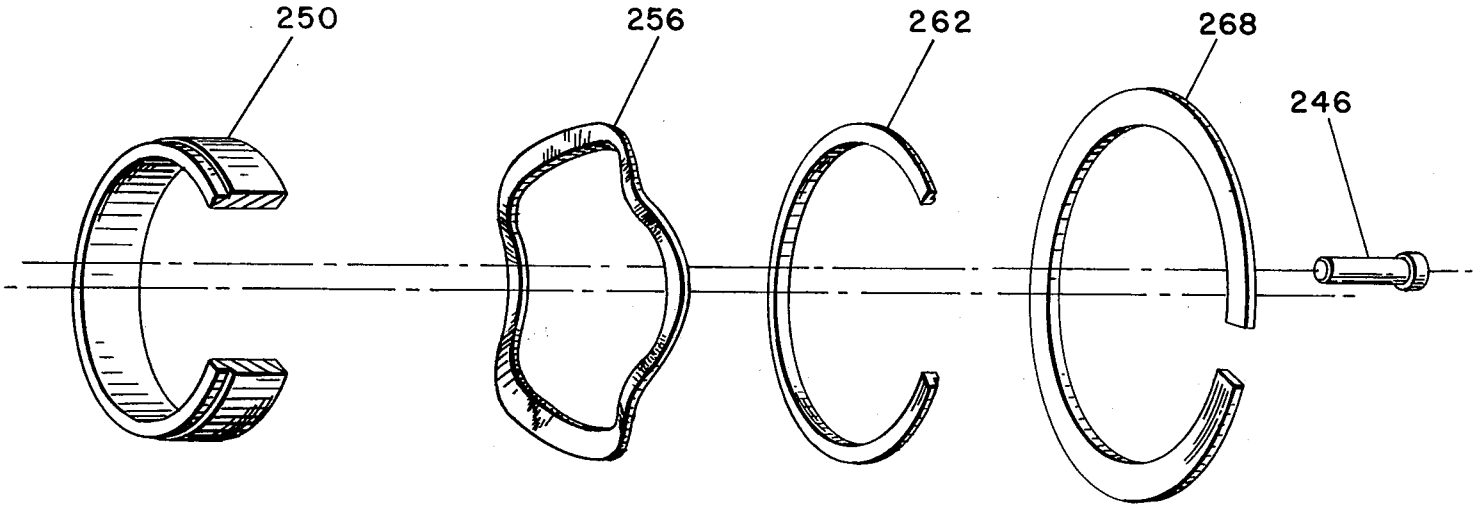

FIGS. 4–6 show parts of electrical connectors usable with the inventive contribution of the instant application. A pair of spring detent means 160 is shown, each of which is of arcuate configuration and has an internal key 162 midway between the ends of the detent spring means 160. Key 162 is loosely engagable and slidable in a keyway 174 on the outer surface 172 of a plug housing 170. Detent spring means 160 in combination with an interior annular groove in the nose portion of the detent shell 134, first and second sets of detent spring recesses being formed in that interior annular groove (not shown to eliminate clutter) emit a distinct snap or click when the electrical connections of the receptacle and the plug are fully mated and the two shells are locked. For a detailed presentation of the assembly of such detent springs into an electrical connector and the function thereof, see Arneson U.S. Pat. No. 4,066,315, issued Jan. 3, 1978, which patent is incorporated herein by reference.

Still in FIG. 4, plug housing 170 has an outer surface 172, one end having a keyway 174 and the other end 176, is threaded to receive a cover shell, not shown, for electrical cable, not shown. On inner surface 178 there is positioned an electromagnetic interference shield 180. Shield 180 is mounted on an inner annular rib 184 of plug housing 170 and includes a plurality of circularly arranged resilient folded fingers 182 adapted to slidably and electrically contact the outer surface of receptacle barrel 28 (FIG. 2). Shield 180 is so constructed and formed that when installed in the interior of plug housing 170 the spaces or windows between adjacent edges of fingers 182 are minimal in width. The shield 180 may be secured as by suitable electrically conductive bonding to annular rib 184. In fully mated position, metal plug housing 170 and metal receptacle shell 22 are provided with a substantially continuous 360° electrically conducting path of low resistance.

For a detailed presentation of the production of and installation of such an EMI shield, see Cooper and Howett, U.S. Pat. No. 4,056,298, issued Nov. 1, 1977, which patent is incorporated herein by reference.

Still in FIG. 4, the interior surface 178 of plug housing 170 includes an elastomeric O-ring 186 positioned in annular groove 188. O-ring 186 is suitably made of silicone rubber. The O-ring helps prevent water and the like from getting into the interior of plug housing 170.

Axial movement for mating/unmating and locking said two sets of electrical contacts is imparted by cammed rotational movement of said plug shell, desirably of substantially less than one rotation. Still in FIG. 4, a set of threads 190 is positioned on the outer surface 172 of plug housing 170. These threads have a high pitch, that is, the length of axial movement is very large for a small amount of rotation. The pitch of these threads is large enough to move the plug means 60 between the fully retracted position and the fully extended position when the plug housing 170 is rotated through substantially less than one rotation. Desirably this rotation is only a small fraction of a turn, such as, one-third of a turn. It is desirable for these threads to be of the square or acme variety. There should be an axial clearance between the thread mating surfaces to allow a limited degree of "float" in the connector, which "float" aids in maintaining the fully compressed state of the various seals in the connector.

Still in FIG. 4, coupling nut 200 is provided on its interior surface with a set of threads 202, complementary to threads 190. On its outer surface, coupling nut 200 is provided with a plurality of keys 204, et seq, which keys are complementary to keys 148, et seq on the interior of detent shell 134 (FIG. 3). One end of each of these keys 204, et seq is flush with the forward end of coupling nut 200. The engaged complementary keys transmit turning forces between coupling nut 200 and detent housing 134, thereby causing relative axial movement between the coupling nut 200 and plug housing 170. Coupling nut 200 terminates in a cross sectionally T-shaped end 208.

FIG. 5 shows the plug means electrical system equivalent of the receptacle means electrical system of FIG. 1. Contact socket 220 with its retainer 222 and hood 224 are one representative of the plurality which are provided for by the inserts. A front socket insert 230 and rear socket insert 236 maintain the sockets securely. These inserts are dielectric materials. Grommet seal 242 seals the rear of this assembly. Seal 242 is typically an elastomeric material, such as silicone rubber. Grommet plug 246 (FIG. 6) seals channel 244 in grommet seal 242. Ring 250 (FIG. 6) retains the inserts and grommet in position within plug housing 170 (FIG. 4). For further detail on this assembly see aforementioned McCormick and Selk, U.S. Pat. No. 3,848,950.

Coupling nut 200 (FIG. 4) and plug housing 170 (FIG. 4) slip inside detent housing 134 (FIG. 3). Spring means 256, FIG. 6, in this instance, a wave washer, is inserted abutting against T-shaped end member 208 (FIG. 4) in an assembled connector. A rear cover ring, 262 (FIG. 6) presses against spring means 256 and retaining ring 268 holds the various shells inside detent housing 134 (FIG. 3) in cooperation with annular groove 149 (FIG. 3).

UNLOCKING/UNMATING ACTION

FIGS. 7–9 show an embodiment of the electrical connector of the invention which is somewhat different from the embodiment of FIGS. 1–6. In FIGS. 7–9, receptacle means 20' includes the electrical sockets 220 and accessories and the plug means 60' includes the electrical pins 44 and accessories. This is the reverse of the arrangement show in FIGS. 1-6. These electrical arrangements are recognized alternates. In order to have a stronger lockup, in FIGS. 7-9 the receptacle barrel 28' is provided with a plurality of keys 30', each of keys 30' having at the end farthest from the barrel nose, a lip 31 having a squared end 36', which squared end 36' performs like squared end 36 of FIGS. 1-6.

Because this connector of FIGS. 7-9 is fundamentally that described in connection with FIGS. 1-6, and to obtain less clutter in the figures, only those elements of direct concern to the condition or action, being described, or needed for clarity, have been assigned numerals in FIGS. 7-9. Elements in FIGS. 7-9 identical with elements in FIGS. 1-6, such as, arcuate detents 160, carry the same numeral. Elements in FIGS. 7-9 which differ in some detail but have the same function as complementary members in FIGS. 1-6 carry the same numeral with the addition of a 'prime'. Where no corresponding element is present in FIGS. 1-6, a new numeral has been assigned.

FIG. 7 shows a locked/mated connector of the invention. Receptacle 20' has a flange 24 and a barrel 28'. Shown on the upper half of the view, barrel 28' has on its outer surface key 30', provided with lip 31, at the end farthest from the nose of barrel 28'. The end 36' of lip 31 nearest flange 24 is squared. Otherwise barrel 28' is constructed like barrel 28 (FIG. 2). See FIG. 9 for a clearer view of elements 30', 31, and 36'.

Positioned inside barrel 28' are dielectric inserts, such as 230, seals, and electrical contact sockets 220 and accessories. This construction is identical to that shown in FIG. 5 and insert 250 of FIG. 6, as part of plug means 60, and in the description thereof.

Continuing in FIG. 7, plug means 60' includes within plug housing 170, the dielectric inserts, such as 40, seals, and electrical pin 44 and accessories. Because of its importance, elastomeric interface seal 56, positioned on insert 40, has been numbered. The detail of these electrical elements is shown in and described in connection with FIG. 1. Pin 44 is disposed well into socket 220 in this fully mated position.

Continuing in FIG. 7, coupling nut 200 threads are fully engaged with plug housing 170 threads in the fully advanced position. Detent shell 134 encloses coupling nut 200. Spring means 256; cover ring 262; and retaining ring 268 appear in the assembled condition. Detent shell nose 146 contacts the inside of collet flange-lip 66. Collet side 98, base 94, notch-slot 96, and slot 90 are shown. Ring coupling 110 on the exterior of plug means 60' pushes its ring opening means 115 against collet side 98 while detent shell nose 146 constrains from underneath. Rod member 124, surrounded by helical spring 122, extends beyond detent shell 134 and is held at the desired length by nut 125. It is evident that the collet circumferential lengths have been rocked so as to bring the end of flange-lip 66 into frictional locking contact with the squared end 36' of keylip 31. Collet base 94 is as far from the outer surface fo detent shell 134 as the undercut in the inner surface of coupling ring 110 allows, causing the locking contact of collet flange-lip 66 and squared end 36' of keylip 31.

In the embodiment of FIGS. 7-9, detent shell nose 146 is provided with a stud 147 whose protruding end fits loosely in collet slot 90.

In the unlocked, unmated and cocked condition of the connector the sloped portion 115 of coupling ring 110 contacts (sits against) the collet side 98 and base 94, as shown in FIGS. 8-9, rocking the collet circumferential lengths and opening the diameter of the flange-lips 66 far enough to allow the keylips 31 to pass underneath. The threads are in the withdrawn, cocked, position—not shown. It is readily seen that turning coupling ring 110 causes the plug means simultaneously to rotate to move axially forward. Slope 115 imparts rocker motion to the collet circumferential lengths by pushing against side 98 and detent nose 146 rocks the flange-lip to a square condition for abutting relation with the keylip 31 squared end 36' and frictional locking is attained as the flange-lip completes its rotational movement when coupling ring 110 reaches its farthest axial movement. The electrical elements 44 and 220 have fully mated an instant before lockup is complete.

FIG. 8 shows the connector in the unlocked but mated condition. Pin 44 is still inserted the same length into socket 220. A lanyard, such as that of FIG. 3, not shown here to avoid clutter, has pulled coupling ring 110 backward, that is, away from receptacle means 20' as shown by the shortening of spring 122 and the extension of rod 124 and nut 125 beyond the end of detent shell 134. The slope 115 on coupling ring 110 breaks contact with collet side 98 and simultaneously moves side 98 and base 94 in rocker motion downward. Detent shell nose 146 cooperates to move flange-lip 66 out of the locked, abutted position relative to keylip 31 and together slope 115 and nose 146 open the diameter of flange-lip 66 so that the flange-lip can pass above the keylip 31, thereby unlocking the receptacle means 20' from the plug means 60'.

In FIG. 9, the connector is shown in the unmated condition. Nothing has happened to the relationship in space of coupling ring 110, detent shell 134, collet 64, coupling nut 200, and plug housing 170 as set forth in FIG. 8. The axial backward pull of the lanyard sets the coupling ring 110 in backward motion. After the unlocking operation has been completed, the backward motion continues until the pins 44 emerge from the socket 220 and the unmated condition, as shown, is attained.

It is pointed out that the lanyard activated unlock/unmate action does not place the plug means in a cocked condition, ready for mating/locking with another receptacle. The advanced threads of coupling nut 200 and plug housing 170 must be rotated backward manually to have the cocked position. To mate, the two shells are aligned by the defined keys and keyways, and the pins and sockets partially mated. Then rotation of the coupling ring 110 advances the pins into mated position. Further rotation completes mating and engages the flange-lip and keylips to reach the locked condition.

The advantage of the present invention, as well as certain changes and modifications to the disclosed embodiments thereof, will be readily apparent to those skilled in the art. It is the applicant's intention to cover all those changes and modifications which could be made to the embodiments of the invention herein chosen for the purposes of the disclosure without departing from the spirit and scope of the invention.

Thus having described the invention, what is claimed is:

1. A quick-release circular electrical connector, comprising:

a. receptacle means including a receptacle shell provided with a receptacle barrel and a set of electrical contacts;

b. said receptacle barrel having positioned, circumferentially, on its exterior surface a plurality of keys, each of said keys being squared at the end farthest from the nose of said barrel, and each of said squared ends being located on a common circumference around said barrel;

c. plug means including
a set of electrical contacts, and
a plug shell means comprising,
a collet,
a coupling ring means, and
a detent shell;

d. said receptacle electrical contacts and said plug electrical contacts being capable of mating to complete an electrical circuit and unmating to break said electrical circuit;

e. said plug shell means being capable of mating/unmating said two sets of electrical contacts through an axial movement imparted by rotational movement of said coupling ring means of substantially less than one rotation, where said mating action includes placing in a locked condition said plug means and said receptacle means through cooperation of said keys and said collet;

f. said collet having a flange-lip extending radially inward from a ring member, which ring member terminates in a base,
said flange-lip defining an opening, said opening having a diameter slightly smaller than the outside diameter of said keys,
said flange-lip having keyways corresponding to said receptacle barrel keys, and
said collet being divided into a plurality of circumferential lengths,
the flange-lip portion of each circumferential length being brought into locked, abutted relation with said squared ends of said keys through said rotational movement of said coupling ring means which is imparted to said circumferential lengths, the effective flange-lip diameter being smaller than said key outside diameter during mating/locking action;

g. said coupling ring means having a ring opening portion slightly larger in diameter to enclose said collet base, and having resilient means mechanically biasing said coupling means and permitting pull back of the coupling ring means;

h. said detent shell having an element for contacting said resilient means, and a nose portion on said coupling ring for assisting said detent shell to impart rocker motion to said collet circumferential lengths; and i. a quick release trigger means for withdrawing said coupling ring forcefully from contact with said ring member of said collet, thereby imparting said rocker motion to said circumferential lengths which increases the flange-lip opening diameter beyond the outside diameter of said keys to unlock said plug means from said receptacle means, and continued axial movement imparted by said trigger means unmates said plug means and said receptacle means.

2. The connector of claim 1 wherein said divided collet has at least three circumferential lengths.

3. The connector of claim 1 wherein said ring opening portion is a truncated outwardly directed conical element at the end of said coupling ring means facing said receptacle means.

4. The connector of claim 1 wherein said detent shell nose has a substantially conical shape.

5. The connector of claim 1 wherein said coupling ring resilient means comprises a helical spring and a rod member support therefor.

6. The connector of claim 1 wherein said quick release trigger means includes a lanyard.

7. The connector of claim 1 wherein said cammed rotational movement is imparted by a high pitch thread element included in said plug means.

8. A quick-release electrical connector, comprising:

(a) receptacle means including at least one electrical contact within a barrel having a plurality of keys circumferentially disposed about its exterior surface; and (b) plug means including at least one electrical contact; means for moving said at least one electrical contact within said plug means along the longitudinal axis of said plug means; and quick-release means comprising collet means having a plurality of internal keyways for receiving said plurality of keys disposed about the exterior of the receptacle means barrel, and said collet means being divided into a plurality of circumferential lengths, said circumferential lengths being capable of radial movement to define an opening of variable diameter for engagement/disengagement with said plurality of keys, thereby to lock said plug means to said receptacle means by engagement with said plurality of keys, and to unlock said plug means from said receptacle means by disengagement from said plurality of keys in response to a momentary force applied to said quick-release means which causes said collet means to expand to an enlarged diameter to allow release of said receptacle means.

9. The connector according to claim 8, wherein said plug means further comprises detent shell means containing said means-for-moving and having a nose portion, and coupling ring means having an interior surface and being slidably movable with respect to said detent shell means along said longitudinal axis and mechanically biased away from said detent shell means, said collet means being cooperative with said detent shell means and said coupling ring means to have a reduced diameter when said coupling ring means is in a first, normal position with respect to said detent shell means and to have an enlarged diameter when said coupling ring means is moved toward a second position with respect to said detent shell means by said momentary force against said mechanical bias.

10. The connector according to claim 9, wherein said plurality of circumferential lengths are rocked about said nose portion of said detent shell means in response to camming by said interior surface of said coupling ring means.

* * * * *